US008129664B2

(12) United States Patent
Keishima et al.

(10) Patent No.: US 8,129,664 B2
(45) Date of Patent: Mar. 6, 2012

(54) INDUCTION HEATER

(75) Inventors: Toshihiro Keishima, Hyogo (JP); Hiroshi Matsuo, Hyogo (JP); Miyuki Kani, Hyogo (JP)

(73) Assignee: Panasonic Corporation, Osaka (JP)

( * ) Notice: Subject to any disclaimer, the term of this patent is extended or adjusted under 35 U.S.C. 154(b) by 625 days.

(21) Appl. No.: 11/575,921

(22) PCT Filed: Jan. 27, 2006

(86) PCT No.: PCT/JP2006/301275

§ 371 (c)(1),
(2), (4) Date: Mar. 23, 2007

(87) PCT Pub. No.: WO2006/082753

PCT Pub. Date: Aug. 10, 2006

(65) Prior Publication Data

US 2009/0212043 A1 Aug. 27, 2009

(30) Foreign Application Priority Data

Feb. 4, 2005 (JP) ..... 2005-028750
Apr. 28, 2005 (JP) ..... 2005-131968

(51) Int. Cl.
*H05B 6/12* (2006.01)

(52) U.S. Cl. ..... 219/622; 219/620; 219/624

(58) Field of Classification Search ..... 219/620, 219/621, 647, 622, 648, 636, 624, 632, 623, 219/627, 625, 602, 660, 668, 672, 676, 630, 219/626, 443.1, 447.1, 446.1, 451.1, 449.1, 219/452.11, 452.12, 454.12, 457.1, 458.1, 219/459.1, 460.1, 465.1, 536, 526, 541, 546, 219/542, 661; 126/39 H, 275 E, 218, 215, 126/275 R, 1 R See application file for complete search history.

(56) References Cited

U.S. PATENT DOCUMENTS 4,189,633 A * 2/1980 Skinner ..... 219/455.11
4,871,902 A * 10/1989 Kicherer ..... 219/458.1

(Continued)

FOREIGN PATENT DOCUMENTS

JP 50-82646 7/1975

(Continued)

OTHER PUBLICATIONS

European Search Report fro Application No. 06 71 2441 dated Sep. 21, 2007.

(Continued)

*Primary Examiner* — Quang T. Van
*Assistant Examiner* — Hung Nguyen
(74) *Attorney, Agent, or Firm* — RatnerPrestia

(57) ABSTRACT

An induction heater which has an electrical conductor between a heating coil and a top plate. The electrical conductor has an extended portion formed downward from its outer periphery. The extended portion has a connector at its tip for coupling to a low-potential part. A thermal-connection reducing means is provided on the extended portion. A cross-sectional shape near a bent portion of the extended portion is made uniform. With the above structure, the electrical conductor has both the functions of decreasing the buoyancy and electrostatic shielding. This structure uses a smaller number of components, eliminates the risk of electric shock to the human body, and prevents uplift of an object to be heated. The thermal-connection reducing means reduces heat conduction to a connected part. Accordingly, a highly reliable and compact apparatus becomes available.

14 Claims, 7 Drawing Sheets

U.S. PATENT DOCUMENTS

| | | | | |
|---|---|---|---|---|
| 7,057,144 | B2 | 6/2006 | Hirota et al. | |
| 7,176,423 | B2 | 2/2007 | Kataoka et al. | |
| 2003/0232515 | A1* | 12/2003 | Shepherd | 439/18 |
| 2004/0217098 | A1* | 11/2004 | Polikarpus et al. | 219/209 |
| 2004/0245244 | A1* | 12/2004 | Hirota et al. | 219/624 |
| 2005/0115957 | A1* | 6/2005 | Kataoka et al. | 219/620 |

FOREIGN PATENT DOCUMENTS

| | | | |
|---|---|---|---|
| JP | 7-249480 | A | 9/1995 |
| JP | 10-125898 | A | 5/1998 |
| JP | 10-223365 | A | 8/1998 |
| JP | 2003-133163 | A | 5/2003 |
| JP | 2003-264054 | A | 9/2003 |
| JP | 2003-264054 | A | 9/2003 |
| JP | 2003-272812 | A | 9/2003 |
| JP | 2004-146149 | A | 5/2004 |
| JP | 2004171926 | A * | 6/2004 |
| JP | 2005-222822 | A | 8/2005 |
| JP | 2005-222822 | A | 8/2005 |
| WO | WO 2004/016047 | A1 | 2/2004 |
| WO | WO 2004/016047 | A1 | 2/2004 |
| WO | WO 2005/006813 | A1 | 1/2005 |

OTHER PUBLICATIONS

International Search Report for PCT/JP2006/301275, dated Apr. 18, 2006.

* cited by examiner

INDUCTION HEATER

This application is a U.S. National Phase Application of PCT International Application PCT/JP2006/301275.

TECHNICAL FIELD

The present invention relates to induction heater in which an electrical conductor is provided between an object to be heated and a heating coil.

BACKGROUND ART

An induction heater induces eddy currents and heats an object to be heated which is a load, such as a cooking pan, using a high-frequency magnetic field generated by a heating coil. This induction heater is a focus of attention because of its advantages of high heat efficiency, safety, and cleanliness. Induction heater that can heat objects with low magnetic permeability and high electrical conductivity, such as aluminum and copper, have recently been developed in addition to apparatuses for objects with high magnetic permeability, such as iron, and those with low magnetic permeability and low electrical conductivity, such as nonmagnetic stainless steel.

In these induction heating apparatuses, stray capacitance (equivalent capacity) exists between the heating coil and the object to be heated. If the user touches the object to be heated, a current travels from the heating coil to the ground through the stray capacitance and internal resistance (equivalent resistance) of the user's body. To heat an object with low magnetic permeability and high electrical conductivity, the number of coil windings in the heating coil needs to be greater and the voltage applied to the heating coil needs to be higher than when heating an object with high magnetic permeability or an object with low magnetic permeability and low electrical conductivity. This may cause leakage of current exceeding a predetermined level from the high-voltage heating coil to the human body. The passing of a leak current through the human body thus needs to be prevented in the case of an induction heater designed to heat objects with low magnetic permeability and high electrical conductivity. For example, the Japanese Utility Model Unexamined Publication No. 50-82046 provides a conductive film on the rear face of a top plate, and this conductive film is grounded so as to prevent any leak current from passing through the human body.

The induction heater adjusts the distribution of heating temperature in the object to be heated by changing the content of the magnetic flux reaching the object. For example, Japanese Patent Unexamined Publication No. 7-249480 provides a ring-shaped electrical conductor between the heating coil and the object to be heated for adjusting the temperature distribution. In this case, the electrical conductor has a slit between the outer periphery and inner periphery. An induction current in a direction opposite the high-frequency current of the heating coil flows in the electrical conductor, but the slit shuts off this induction current. The temperature distribution in the object to be heated is adjusted by regulating the distribution of intensity of magnetic field using the high-frequency current flowing in the heating coil and the induction current flowing in the electrical conductor.

For heating an object with low magnetic permeability and high electrical conductivity, the ring-shaped electrical conductor disposed between the heating coil and the object reduces the buoyancy exerted on the heated object. In this case, however, the heating value of the electrical conductor increases. Accordingly, in the case of apparatuses with a top control panel, which are becoming increasingly popular, the electrical conductor needs to be provided in a position distant from the top control panel to prevent any damage by the heat from the electrical conductor to the liquid crystal device (LCD) provided below the top plate for top-panel operation. In addition, a compact design in both width and height is required by high-density assembly inside the casing to satisfy demand for higher performance.

However, in a conventional structure, the conductive film for preventing the leak current from flowing to the human body and the electrical conductor for decreasing the buoyancy, when heating an object with low magnetic permeability and high electrical conductivity, are separate components. Accordingly, costs are high for an induction heater which has these functions. In addition, more compact designs are demanded.

SUMMARY OF THE INVENTION

An induction heater of the present invention has an electrical conductor provided between a heating coil and a top plate for decreasing the buoyancy exerted on an object to be heated during induction-heating of the object made of non-magnetic metal with conductivity equivalent to or higher than aluminum. This electrical conductor includes an extended portion extending at least downward from the electrical conductor, a connector provided on the extended portion, and a thermal-connection reducing means provided between the electrical conductor at the extended portion and the connector for reducing heat conduction from the electrical conductor to the connector. The connector is pluggable to a coupler to a low-potential part for coupling to the low-potential part.

Since the electrical conductor has the connector which is pluggable to the coupler to the low-potential part for coupling to the low-potential part, the electric connector has both the functions of reducing the buoyancy and electrostatic shielding. Accordingly, the present invention offers the induction heater that has a smaller number of components, eliminates the risk of electric shock to the human body, and prevents uplift of an object to be heated during induction-heating of the object made of non-magnetic metal with conductivity equivalent to or higher than aluminum. The extended portion has a part extending at least downward from the electrical conductor. This enables a compact electrical conductor without enlarging the size of the electrical conductor, in particular, in the radial direction. A space for providing peripheral components such as LCDs can thus be secured near the top face, or any detrimental thermal effect due to the heat generated from the electrical conductor to these components can be suppressed. Still more, the thermal-connection reducing means is provided on the extended portion. This reduces heat conduction to the connector, and eventually reduces the temperature of the connector. An electrical connection is thus ensured, achieving a highly reliable and compact induction heater.

Furthermore, the extended portion has a part extending at least downward from the electrical conductor and may also have a bent portion bent outward or inward below a support holding the heating coil. The bent portion suppresses further downward extension of the extended portion while extending a distance from the electrical conductor to the connector. This reduces heat conduction to the connector, and eventually reduces the temperature of the connector. In addition, a stress concentrated on a part to bent in the bent portion can be reduced by making a cross-sectional shape uniform near the part to be bent. This improves the strength (bending resistance). Accordingly, an electrical connection is ensured, achieving a highly reliable and compact induction heater.

REFERENCE MARKS IN THE DRAWINGS

Figure 1:
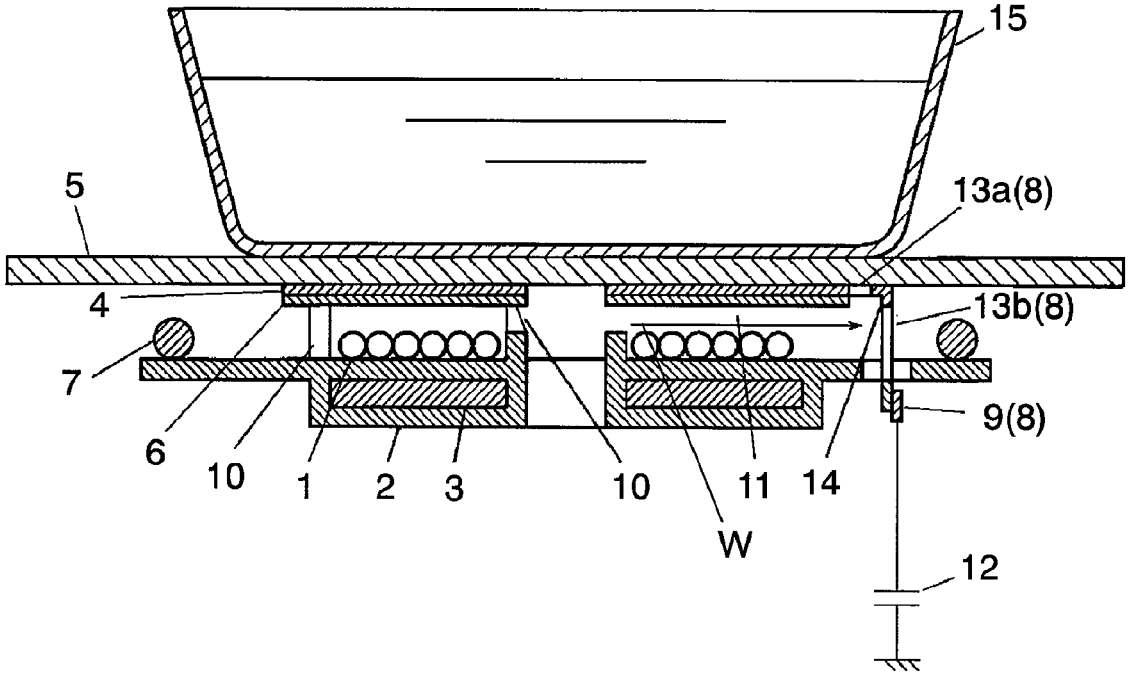
FIG. 1 is a sectional view of an induction heater in accordance with a first exemplary embodiment of the present invention.

1 Heating coil
2 Support
4 Electrical conductor
5 Top plate
8 Extended portion
9 Connector
10 Supporting portion
11 Space
12 Capacitor
13 Hole
14 Curved portion
15 Object to be heated
16 Flat connecting terminal
17 Bent portion
18 Duct
19 Slit
20 Thermal-connection reducing means
47 Extended portion
48 Connector
51 Capacitor
52 Curved portion
54 Connecting terminal
55 Bent portion
56 Guide
57 Stopper
58 Stopper
59 Bending angle adjuster
60 Electrical conductor
61 Extended portion

DETAILED DESCRIPTION OF PREFERRED EMBODIMENTS

An induction heater of the present invention includes a top plate for placing an object to be heated, a heating coil disposed below the top plate for induction-heating the object, and an electrical conductor disposed between the heating coil and the top plate such that the electrical conductor faces the heating coil. The electrical conductor decreases the buoyancy during induction-heating of the object made of non-magnetic metal with electrical conductivity equivalent to or higher than aluminum. The electrical conductor includes an extended portion extending at least downward from the electrical conductor, a connector provided on the extended portion that is pluggable to a coupler to a low-potential part for coupling to the low-potential part, and a thermal-connection reducing means provided on the extended portion for reducing heat conduction from the electrical conductor to the connector. With this structure, the electrical conductor demonstrates both the functions of decreasing the buoyancy and electrostatic shielding. Accordingly, the present invention offers an induction heater which uses a smaller number of components, eliminates the risk of electric shock to the human body, and prevents uplift of an object to be heated. In addition, the extended portion extending downward from the outer periphery of the electrical conductor avoids enlarging the electrical conductor, in particular, in the radial direction. This offers a compact electrical conductor which secures a space for peripheral components such as LCDs provided near the top face, or suppresses any detrimental thermal effects due to heat generated from the electrical conductor to these components. Furthermore, the thermal-connection reducing means provided on the extended portion reduces heat conduction to the connector, and eventually reduces the temperature of the connector. An electrical connection is thus ensured, achieving a highly reliable and compact induction heater.

Still more, another induction heater of the present invention includes a top plate for placing an object to be heated, a heating coil provided below the top plate for induction-heating the object, and a plate-like electrical conductor disposed between the heating coil and the top plate such that the electrical conductor faces the heating coil. The electrical conductor decreases the buoyancy exerted on the object to be heated during induction-heating of the object made of nonmagnetic metal with electrical conductivity equivalent to or higher than aluminum. The electrical conductor includes an extended portion extending at least downward from the electrical conductor, and a connector provided on the extended portion that is pluggable to a coupler to a low-potential part for coupling to the low-potential part. This extended portion has a bent portion bent outward or inward below a support holding the heating coil.

In the above structure, the electrical conductor has both the functions of decreasing the buoyancy and electrostatic shielding. Accordingly, an induction heater which has a smaller number of components, eliminates the risk of electrical shock to the human body, and prevents uplift of the object to be heated is achievable. The connector formed downward from the outer periphery of the electrical conductor avoids enlarging the size of the electrical conductor, in particular, in the radial direction. This offers a compact electrical conductor which can suppress any detrimental thermal effects of the electrical conductor on peripheral components on the top face, such as LCDs.

Furthermore, the extended portion extending at least downward from the electrical conductor has a bent portion which is bent outward or inward below the support holding the heating coil. This provides a longer distance from the electrical conductor to the connector while suppressing further downward extension of the extended portion, so that heat conduction to the connector can be reduced, and eventually the temperature of the connector can be reduced. A cross-sectional shape near a part to be bent in the bent portion is made uniform such that the stress is less concentrated on the part to be bent, giving it better strength (bending resistance). This ensures electrical connection, achieving a highly reliable and compact induction heater.

Exemplary embodiments of the present invention are described below with reference to drawings. It is apparent that the present invention is not limited to these exemplary embodiments.

First Exemplary Embodiment

Figure 2A:
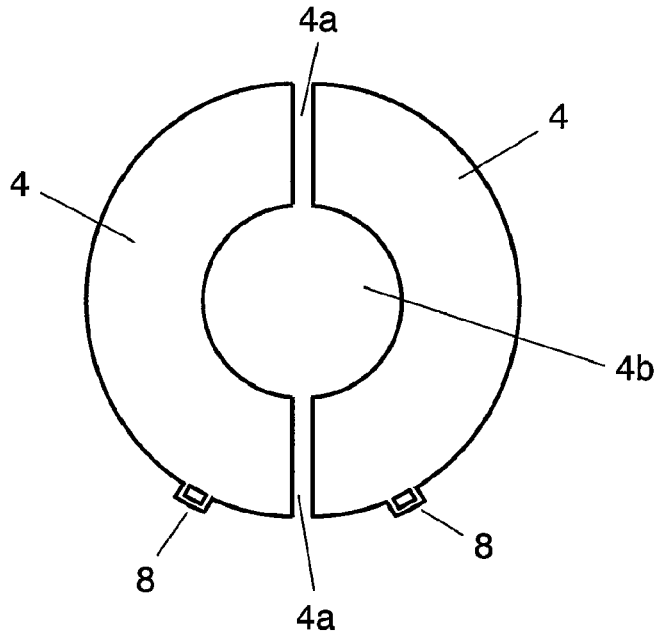
FIG. 2A is a plan view of a key part of the induction heater in accordance with the first exemplary embodiment of the present invention.
Figure 2B:
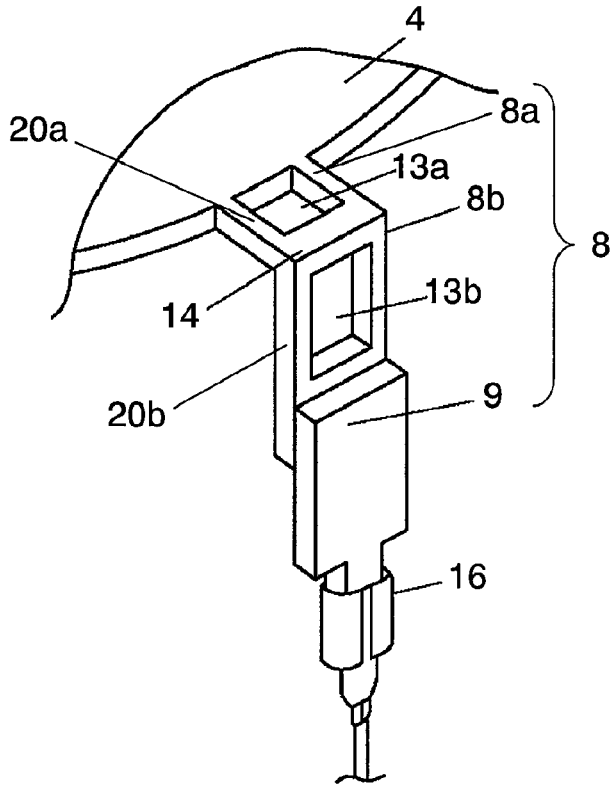
FIG. 2B is a perspective view of a key part in accordance with the first exemplary embodiment of the present invention.

FIGS. 1, 2A, and 2B illustrate an induction heater in the first exemplary embodiment of the present invention.

The induction heater in the first exemplary embodiment includes top plate 5 on which object 15 to be heated, such as a cooking pot and pan, is placed; heating coil 1 disposed below top plate 5 for induction-heating object 15; and plate-like electrical conductor 4 provided between heating coil 1 and top plate 5. Electrical conductor 4 has extended portion 8 which first extends laterally (a direction on the same face as electrical conductor 4) from electrical conductor 4 for a little distance and then extends downward (roughly perpendicular to the face of electrical conductor 4), which is strip-shaped lower conductive part 8*b*; connector 9 which is provided at a tip of extended portion 8 and is pluggable to flat connecting terminal 16 which is a coupler to a low-potential part for coupling to the low-potential part; and thermal-connection reducing means 20*a* and 20*b* provided on extended portion 8 for reducing conduction of heat from electrical conductor 4 to connector 9.

When a high-frequency current is supplied from a control circuit (not illustrated), heating coil 1 generates a high-frequency magnetic field so as to induction-heat object 15. The high-frequency current of 50 kHz or higher can be supplied to heating coil 1, and thus object 15 to be heated made of nonmagnetic metal with electrical conductivity equivalent to or higher than aluminum can be induction-heated. An inner periphery of heating coil 1 is set to a high-potential side, and an outer periphery is set to a low-potential side. Heating coil 1 is placed on and held by support 2.

Support 2 made of heat-resistant resin has ferrite core 3 below heating coil 1 disposed roughly parallel to heating coil 1. Support 2 is formed such that it covers the surface of ferrite core 3 so that ferrite core 3 and heating coil 1 are electrically insulated.

Electrical conductor 4 is provided between heating coil 1 and top plate 5 such that electrical conductor 4 faces heating coil 1. More preferably, insulating sheet 6 is further provided, and electrical conductor 4 is sandwiched and retained between insulating sheet 6 and top plate 5. Electrical conductor supporting portion 10 protruding from support 2 positions electrical conductor 4 via insulating sheet 6. Electrical conductor 4 is placed on insulating sheet 6 so that electrical conductor 4 is electrically insulated from heating coil 1 via space 11. Electrical conductor supporting portion 10 is about 2 mm wide at the side of the inner periphery of heating coil 1, and is provided at four points. At the side of the outer periphery, electrical conductor supporting portion 10 is about 15 mm wide, and is provided at twelve points at even intervals so that electrical conductor supporting portions 10 do not shut off cooling wind passing over the top face of heating coil 1.

Electrical conductor 4 is made of an aluminum sheet which is roughly 1 mm thick. As shown in FIG. 2A, electrical conductor 4 is roughly ring shaped, in a plan view, and has an inner opening. An outer diameter and inner diameter of electrical conductor 4 are roughly the same as that of heating coil 1. Electrical conductor 4, divided into two parts by slit 4*a* of roughly 10 mm wide, covers heating coil 1. Extended portion 8 extending from electrical conductor 4 is formed at one point on the outer periphery of each of the divided parts of electrical conductor 4. Each extended portion 8 has horizontal conductive part 8*a* and lower conductive part 8*b* integrally formed with electrical conductor 4 using the same material, and connector 9 made of stainless steel. Stainless steel is used for connector 9 in this exemplary embodiment, but connector 9 may also be plated. Stainless steel is SUS430 or SUS 304, and plated typically with nickel-chrome, chrome, or aluminum.

Thermal-connection reducing means 20 is a portion provided on a part of extended portion 8, and is formed by creating one or more holes 13 on roughly the center line of extended portion 8 between electrical conductor 4 and connector 9. At thermal-connection reducing means 20, that is extended portion 8 where hole 13 is created, has a smaller cross-sectional area than other part of extended portion 8. This reduces heat conduction from electrical conductor 4 to connector 9, and eventually suppresses temperature rise of connector 9. As shown in FIG. 2B, hole 13 is created at two points in extended portion 8 in the first exemplary embodiment, and they are called holes 13*a* and 13*b*. No hole is created in curved portion 14. External wiring is connected by inserting flat connecting terminal 16, which is a coupler to the low-potential part provided at an end of external wiring, to a tip of connector 9. Connector 9 is electrically coupled, via external wiring and capacitor 12, to commercial power potential, potential after rectifying commercial power to be input to an inverter supplying a high-frequency current to heating coil 1, or a low-potential part such as the ground.

Connector 9 and lower conductive part 8*b* configuring extended portion 8 are coupled typically by caulking or welding. If there is a risk of corrosion due to connection of different metals, silicone or the like may be applied to insulate air.

Top plate 5, which is an electrical insulator, is made of heat-resistant ceramics. Object 15 to be heated made of a material with low magnetic permeability and high electrical conductivity, such as aluminum and copper, is placed on top plate 5 such that object 15 faces heating coil 1. Shield ring 7 is made of aluminum lead, die-cast ring, or pressed part, and is provided around the outer periphery of heating coil 1 and ferrite core 3.

The operation of the induction heater as assembled above is described below.

When the high-frequency current is supplied to heating coil 1 from a control circuit (not illustrated), heating coil 1 generates a magnetic field. This high-frequency magnetic field generated induces the current on a bottom face of object 15 to be heated. If there is no electrical conductor 4, the induction current induced in object 15 cancels the magnetic field generated from heating coil 1. Consequently, the induction current in a direction opposite to and parallel with the heating coil current is induced in object 15. Since object 15 to be heated is made of a material with low magnetic permeability and high electrical conductivity, such as aluminum and copper, a repulsive force that acts away from heating coil 1 is exerted on the bottom of object 15 due to interaction of the induction current and heating coil current. This exerts the buoyancy on object 15 to be heated.

If electrical conductor 4 is provided, a plate of electrical conductor 4 is provided facing a part or entire face of heating coil 1 at the side of object 15 to be heated. Accordingly, the magnetic field generated by heating coil 1 is interlinked to electrical conductor 4, and the induction current is induced in electrical conductor 4. Electrical conductor 4 is about 1 mm thick, which is a thickness thicker than a permeable depth. Accordingly, most of the magnetic field interlinked to electrical conductor 4 does not pass through electrical conductor 4, but goes toward object 15 to be heated around the outer periphery of electrical conductor 4 or through opening 4*b* at the inner periphery of electrical conductor 4. In other words, distribution of the current induced in object 15 to be heated changes by generating the induction current in electrical conductor 4.

The magnetic field generated by heating coil 1 is interlinked to electrical conductor 4 and object 15 to be heated, and the induction current is generated in both. The induction current induced in object 15 to be heated is generated by interlinkage of superimposed magnetic-field distribution of a magnetic-field distribution generated in heating coil 1 and a magnetic-field distribution generated by the current induced in electrical conductor 4. Accordingly, provision of electrical conductor 4 changes the distribution of current induced in object 15. In addition, the distribution of current generated in electrical conductor 4 is added. This increases the equivalent series resistance of heating coil 1. The equivalent series resistance here refers to an equivalent series resistance in the input impedance of heating coil 1 measured using a frequency close to a heating frequency while object 15 to be heated and electrical conductor 4 are disposed at positions similar to those in their heating states.

A larger equivalent series resistance results in a stronger magnetic coupling between heating coil 1 and object 15 to be heated, and thus the heating value on object 15 increases even with the same heating coil current. Accordingly, the current applied to heating coil 1 can be reduced for achieving the same consumption power, and therefore the buoyancy exerted on object 15 is decreased. In addition, a part of the buoyancy which supposed to be exerted on object 15 is exerted on electrical conductor 4, and thus the buoyancy exerted on object 15 to be heated can be further decreased.

As described above, electrical conductor 4 has a buoyancy-decreasing function which is to decrease the buoyancy exerted on object 15 to be heated, due to the magnetic field generated in heating coil 1, by reducing the current flowing to heating coil 1 in the case of achieving the same output. Consequently, uplift or displacement of object 15 to be heated is preventable when heating object 15 is made of a material with low magnetic permeability and electrical conductivity equivalent to or higher than aluminum or copper.

Since electrical conductor 4 is made of aluminum, it has low magnetic permeability and high electrical conductivity. Magnetic flux is thus unlikely absorbed by electrically conductor 4. In other words, the flux content reaching object 15 does not reduce. The current induced in electrical conductor 4 by interlinkage of the magnetic flux of heating coil 1 and electrical conductor 4 changes the direction and distribution of the magnetic field. The magnetic flux can be interlinked to object 15 for induction-heating, while suppressing generation of the buoyancy, through either route: through opening 4*b* at the inner periphery of electrical conductor 4, or around electrical conductor 4.

In the first exemplary embodiment, the size of electrical conductor 4 is determined such that electrical conductor 4 faces almost the entire heating coil 1 except for slit 4*a*. However, the present invention is not limited to the mode adopted in the first exemplary embodiment. A larger plate of electrical conductor 4 and closer distance between electrical conductor 4 and heating coil 1 increase the effect of equivalent series resistance because more magnetic flux of heating coil 1 passes electrical conductor 4. Accordingly the surface area of electrical conductor 4 is determined taking into account a required buoyancy-decreasing effect, or conditions such as a distance between electrical conductor 4 and heating coil 1 and heat generation in electrical conductor 4. In this exemplary embodiment, two slits 4*a* for limiting annular current induced in electrical conductor 4 are provided. However, three or more slits are also applicable.

Electrostatic coupling between a high-voltage part generated in heating coil 1 and object 15 to be heated is reduced by electrically coupling connector 9 of electrical conductor 4 directly or via a capacitor to a low-potential part. Accordingly, a leak current, which is a high-frequency high voltage generated in heating coil 1, flowing to the user's body via a stray capacitance between heating coil 1 and object 15 to be heated can be suppressed. The low-potential part here refers to parts with potential lower than the high-potential part of heating coil 1. Examples of the low-potential part are such parts as input supply voltage, DC voltage after rectifying supply voltage, and a potential close to the rectified level.

In other words, internal impedance of electrical conductor 4 (including a capacitance of capacitor 12, if any) and synthetic impedance of the stray capacitance between electrical conductor 4 and user's body and the internal impedance of user's body (equivalent impedance) are connected in parallel between electrical conductor 4 and the ground. The internal impedance of electrical conductor 4 is extremely small compared to the stray capacitance and the internal impedance of the user's body, and thus most of the leak current from heating coil 1 flows to the ground through electrical conductor 4, and almost no current leaks to the user's body.

If object 15 to be heated is a cooking pot made of a material with low magnetic permeability and low resistance, such as aluminum or copper, a higher frequency needs to be applied to heating coil 1 to heat object 15 at high power. The peak voltage applied to heating coil 1 becomes increased to 1 kV or higher.

If electrical conductor 4 is electrically coupled to the low-potential part, as described above, the potential difference between object 15 and electrical conductor 4 becomes small, and thus the leak current caused by the human body touching object 15 is significantly reduced. Accordingly, it is safe for the user to touch object 15.

Heating coil 1 is connected to an inverter, which is a driving circuit, such that an outer-periphery terminal has lower potential than that of an inner-periphery terminal. In this case, an area of the high-potential part of heating coil 1 practically facing object 15 to be heated becomes smaller than when heating coil 1 is connected to the inverter such that the outer-periphery terminal has higher potential than that of the inner-periphery terminal. The leak current can thus be reduced.

When a high-frequency current is supplied to heating coil 1, a high-frequency current is induced in shield ring 7 by the magnetic field generated in heating coil 1. The high-frequency current induced in shield ring 7 generates a magnetic field in the same direction as heating coil 1 at the inner periphery of shield ring 7, and a magnetic field in a direction opposite the magnetic field of heating coil 1 at the outer periphery of the ring. Accordingly, leakage of magnetic field from heating coil 1 to the outer periphery can be reduced.

As described above, in the first exemplary embodiment, electrical conductor 4 increases the equivalent series resistance of heating coil 1 when object 15 to be heated is placed facing heating coil 1, and also has a buoyancy-decreasing function that decreases the buoyancy exerted on object 15 by the magnetic field generated by heating coil 1. Accordingly, high-power heating is achievable during cooking while preventing uplift of object 15 to be heated made of a material with low magnetic permeability and high electrical conductivity, such as aluminum, copper, or brass.

Still more, electrical conductor 4 electrically coupled to the low-potential part suppresses the leak current, which is caused by a high-frequency high voltage generated in heating coil 1, from flowing to the user's body via the stray capacitance between heating coil 1 and object 15 to be heated.

Still more, since electrical conductor 4 has both the functions of decreasing the buoyancy and electrostatic shielding, a compact, safe, and inexpensive induction heater with a smaller number of components is achievable.

The temperature rise of electrical conductor 4 is smaller at its area outside the outer periphery of heating coil 1, compared to inside the inner periphery. Accordingly, provision of extended portion 8 outside the outer periphery of heating coil 1 suppresses conduction of heat to extended portion 8.

Still more, extended portion 8 is formed closer to the outer-periphery terminal, which is a low-potential terminal of heating coil 1, than the inner-periphery terminal, which is a high-potential terminal of heating coil 1. This facilitates reliable electrical insulation between heating coil 1 and extended portion 8.

Still more, thermal-connection reducing means 20 can be formed by partially reducing a cross-sectional area (at plural points acceptable) perpendicular to the extending direction of extended portion 8. More specifically, thermal-connection reducing means 20 has a smaller cross-sectional area perpendicular to the extending direction of extended portion 8 than the cross-sectional area perpendicular to the extending direction of extended portion 8 at both sides of thermal-connection reducing means 20. A smaller heat-conducting area in a heat-conducting pathway to connector 9 cuts the thermal connection so that the temperature of connector 9 is reduced. Accordingly, connector 9 after reducing temperature is connected to the low-potential part for ensuring electrical coupling. A reliable induction heater is thus achievable.

Still more, hole 13 is formed at two points (13*a* and 13*b*) on roughly the center line of extended portion 8 so that the heat-conducting area is reduced for cutting the thermal connection. The temperature of connector 9 is thus reduced, and thermal-connection reducing means 20 is achieved with relatively simple means. With respect to the structure, both side faces of holes in extended portion 8 are connected at two points, and thus the shape is stable. Accordingly, a simple, stable, and reliable induction heater is achievable. Thermal-connection reducing means 20 may also be formed by creating hole 13 in extended portion 8 at one point or three or more points.

Still more, the cross-sectional area perpendicular to the extending direction of extended portion 8 at curved portion 14 is made larger than a cross-sectional area perpendicular to the extending direction of extended portion 8 at thermal-connection reducing means 20. This secures a large cross-sectional area for curved portion 14 where strength tends to decrease so that the bending resistance can be improved for achieving a structurally-stable and reliable induction heater.

Electrical conductor 4 is disposed contacting the bottom face of top plate 5. This increases the heat of electrical conductor 4 discharged by heat conduction via top plate 5. When the heat of electrical conductor 4 is discharged from a part of top plate where object 15 to be heated is not placed, the heat generated from electrical conductor 4 cannot contribute to heating of object 15. In the first exemplary embodiment, electrical conductor 4 has lower conductive part 8*b* formed downward by bending at curved portion 14 with respect to horizontal conductive part 8*a* extending horizontally from electrical conductor 4, and also has a structure that the heat is difficult to be transmitted downward. Accordingly, electrical conductor 4 can thermally connect to object 15 to be heated effectively for maintaining the performance. Still more, an area (at the outer periphery side) of electrical conductor 4 contacting top plate 5 needs not to be broadened too much for securing a longer heat-conduction distance to connector 9 so as to suppress temperature rise of connector 9. Accordingly, a part of thermal connection between top plate 5 and electrical conductor 4 which does not contact object 15 to be heated does not increase unnecessarily. Horizontal conductive part 8*a* makes extended portion 8 longer, and thermal-connection reducing means 20, provided in the first exemplary embodiment, reduces the temperature rise of connector 9. However, they are not always necessary, and can be omitted. Extended portion 8 is provided on the outer periphery of electrical conductor 4.

However, the position is also not limited. Extended portion 8 can be provided at area other than the outer periphery.

Furthermore, at least space 11 is provided between heating coil 1 and electrical conductor 4 for passing through cooling wind. Cooling wind W applied to extended portion 8 cools down extended portion 8 so that the temperature of connector 9 can be reduced. Accordingly, a further reliable induction heater is achievable.

Second Exemplary Embodiment

Figure 3:
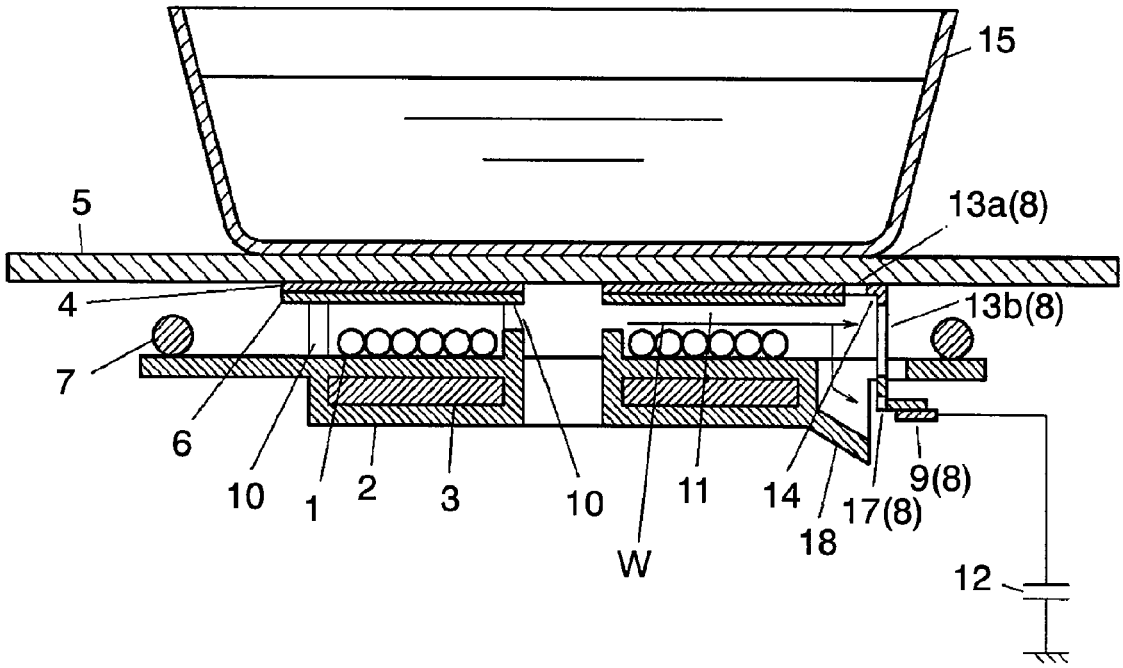
FIG. 3 is a sectional view of an induction heater in accordance with a second exemplary embodiment of the present invention.
Figure 4:
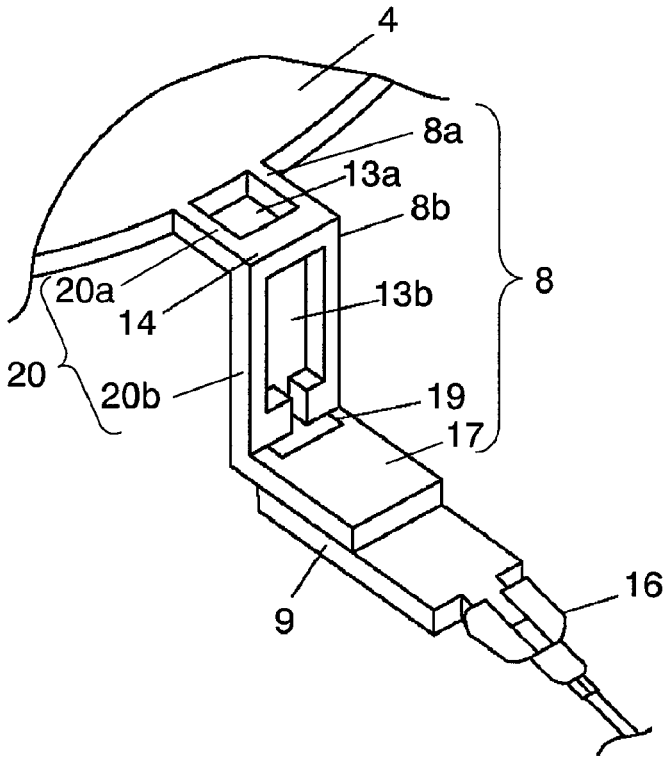
FIG. 4 is a perspective view of a key part of the induction heater in accordance with the second exemplary embodiment of the present invention.

FIGS. 3 and 4 show an induction heater in the second exemplary embodiment of the present invention. Components same as that of the first exemplary embodiment are given the same reference marks to omit duplicate description.

In the induction heater in the second exemplary embodiment, extended portion 8 formed downward includes horizontal conductive part 8*a* extending outward from an end of electrical conductor 4 in the radial direction of heating coil 1, lower conductive part 8*b* formed downward, bent portion 17 bent outward below support 2 holding heating coil 1 in the radial direction of heating coil 1, and connector 9 fixed to bent portion 17 typically by caulking or welding. Connector 9 does not protrude outside of support 2, or at least a protruding distance is minimized. This structure extends a distance from electrical conductor 4 to connector 9 at a tip of extended portion 8. Slit 19 is provided at a boundary area of bent portion 17 against lower conductive part 8*b* so as to facilitate bending.

Duct 18 is provided outside of heating coil 1 and inside of extended portion 8 for feeding cooling wind W to connector 9. This encourages feeding of cooling wind W to connector 9, in addition to extended portion 8, so that the temperature of connector 9 can be further reduced to further improve reliability. Other points are the same as the first exemplary embodiment.

As described above, bent portion 17 is further provided as a thermal-connection reducing means in the second exemplary embodiment so that a distance from electrical conductor 4 to connector 9 at the tip of extended portion 8 can be further extended. This further reduces the temperature of connector 9, achieving a further reliable induction heater. In other words, thermal-connection reducing means 20*a* and 20*b* are formed by creating hole 13 in horizontal conductive part 8*a* and lower conductive part 8*b* so as to make a cross-sectional area perpendicular to the extending direction of extended portion 8 smaller than other area.

Still more, provision of bent portion 17 particularly eliminates protrusion in the height direction, saving a space. Provision of bent portion 17 also makes bent portion 17 or connector 9 contact the bottom face of support 2 so that upward displacement of electrical conductor 4 can be restricted.

Still more, provision of duct 18 for feeding cooling wind to connector 9 further reduces the temperature of connector 9, achieving a further reliable induction heater.

In the first and second exemplary embodiments, as shown in FIG. 2A, each electrical conductor and the low-potential part (commercial power potential or ground) are connected only at a single point of connector 9 (extended portion 8) in each electrical conductor 4. Connector 9 (extended portion 8) may also be provided at multiple points of each electrical conductor 4 so as to improve reliability or detect connection by applying current between multiple connectors 9 provided on the same electrical conductor 4. The safety can be further improved if electricity is applied to heating coil 1 only when the connection is satisfactory.

Third Exemplary Embodiment

Figure 5A:
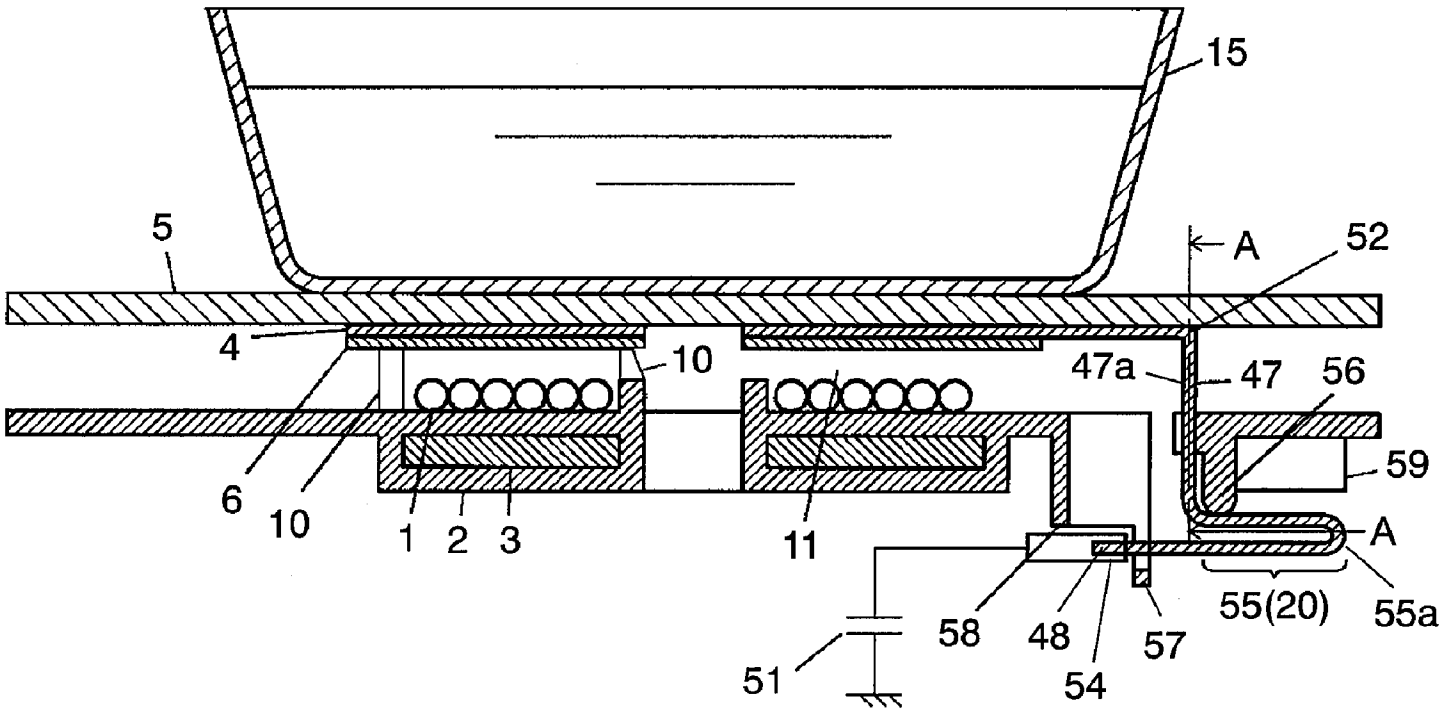
FIG. 5A is a sectional view of an induction heater in accordance with a third exemplary embodiment of the present invention.
Figure 5B:
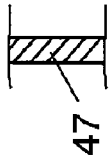
FIG. 5B is a sectional view taken along line A-A in FIG. 5A.
Figure 5C:
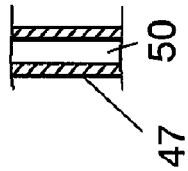
FIG. 5C is another sectional view taken along line A-A in FIG. 5A.

FIGS. 5A, 5B, and 5C show an induction heater in the third exemplary embodiment of the present invention. Components same as that of the first exemplary embodiment are given the same reference marks to omit duplicate description.

In the induction heater in the third exemplary embodiment, electrical conductor 4 is provided such that it contacts a face of top plate 5 at the side of heating coil 1, and has extended portion 47 extending from its outer periphery. Extended portion 47 includes strip-shaped lower conductive part 47*a* formed downward by bending at curved portion 52; bent portion 55; and connector 48 provided at a tip of extended portion 47. Connector 48 is pluggable to connector 54 of a low-potential part provided at the end of wiring for coupling to the low-potential part.

Bent portion 55 is a part that protrudes below support 2 holding heating coil 1 when electrical conductor 4 is placed on insulating sheet 6. After electrical conductor 4 is placed on insulating sheet 6, bent portion 55 is bent outward such that it contacts the underside of support 2. Bent portion 55 is folded back at a tip (second curved portion 55*a*). Connector 48 is disposed roughly horizontal to an inner periphery of bent portion 55 when bent portion 55 is bent outward. This structure enables extension of a distance from electrical conductor 4 to connector 48 at the tip of extended portion 47 along support 2. A cross-sectional shape taken along line A-A of lower conductive part 47*a* is uniform, as shown in fragmentary sectional views in FIGS. 5B and 5C. FIG. 5C is an example that extended portion 47 has slit 50 at its center. Bent portion 55 is also strip-shaped same as lower conductive part 47*a*. Provision of slit on bent portion 55 suppresses heat conduction from electrical conductor 4 to terminal 48.

Bent portion 55 is bent by making outer face of extended portion 47 contact the lower end of guide 56 of support 2. Since support 2 has guide 56 that restricts the curvature of a part to be bent in bent portion 55 with respect to lower conductive part 47*a*, the bending curvature is stable, and bent portion 55 is bent smoothly without excessive bending. Accordingly, a stress does not concentrate and the bending resistance of the bent portion increases, improving reliability.

Support 2 has stopper 57 for restricting downward displacement of extended portion 47. Stopper 58 is also provided on support 2 for restricting upward displacement of extended portion 47 when connector 48 and connecting terminal 54 are connected.

In addition, support 2 has bending angle adjuster 59 for adjusting a bending angle with respect to lower conductive part 47*a* when bent portion 55 is bent outward. When bent portion 55 is bent, it is bent by hand until its outer edge contacts the bottom face of bending angle adjuster 59. This achieves a stable bending angle after bent portion 55 springs back when the hand is released.

Connector 48 at the tip of extended portion 47 is coupled to connecting terminal 54 which is the coupler to the low-potential part for coupling to the low-potential part. In other words, electrical conductor 4 is coupled via capacitor 51 or directly to commercial power potential, a potential after rectifying commercial power input to the inverter for supplying high-frequency current to heating coil 1, or the ground by inserting and coupling connecting terminal 54 to connector 48.

The operation and effect of the induction heater as configured above are described below. Description of the operation and effect same as the first exemplary embodiment are omitted.

The induction heater in the third exemplary embodiment has extended portion 47 which includes lower conductive part 47*a* formed downward from the outer periphery of electrical conductor 4, bent portion 55 bent outward or inward below support 2 holding heating coil 1, and connector 48. Since extended portion 47 has bent portion 55, a distance to connector 48 can be extended, thus reducing heat conduction from electrical conductor 4 to connector 48 and eventually reducing the temperature of connector 48. In other words, bent portion 55 is one form of thermal-connection reducing means 20, and thus has the same effect as hole 13 in the first exemplary embodiment.

Still more, bent portion 55 has a slit. This reduces a cross-sectional area of bent portion 55 perpendicular to its heat-conducting direction, further suppressing heat conduction from electrical conductor 4 to terminal 48.

Still more, bent portion 55, which is thermal-connection reducing means 20, has second curved portion 55*a* bent in the opposite direction. This further extends a distance from electrical conductor 4 to connector 48, and also suppresses radial and downward extension of extended portion 47.

Still more, a cross-sectional shape near a part to be bent in bent portion 55 is made uniform so that stress concentration onto the bent part of bent portion 55 is eliminated, giving the bent part of bent portion 55 better strength (bending resistance). This ensures electrical connection, achieving a highly reliable and compact induction heater.

Bent portion 55 is bent by making the outer face of extended portion 47 contact the lower end of guide 56 of support 2. This stabilizes the bending curvature. This also achieves smooth bending without excessive bending. Accordingly, a stress concentration is eliminated, and the bending resistance of the bent part is improved, achieving high reliability.

Support 2 has stopper 57 for restricting downward displacement of extended portion 47. Stopper 57 restricts downward displacement of extended portion 47 (connector 48), and thus facilitates prevention of interference with components at a lower part. Accordingly, structural stability and reliability are achievable.

Still more, support 2 has stopper 58 which does not contact connector 48 when bent portion 55 is bent outward but restricts upward displacement of extended portion 47 when connector 48 and connecting terminal 54 are coupled. Stopper 58 restricts upward displacement of connecting terminal 54 (connector 48), and thus facilitates prevention of interference with components at an upper part. Accordingly, structural stability and reliability are achievable.

Furthermore, support 2 has bending angle adjuster 59 for adjusting the bending angle of bent portion 55. This facilitates bending at a predetermined bending angle, taking into account a spring-back in bending, improving operability of coupling to connecting terminal 54.

Fourth Exemplary Embodiment

Figure 6A:
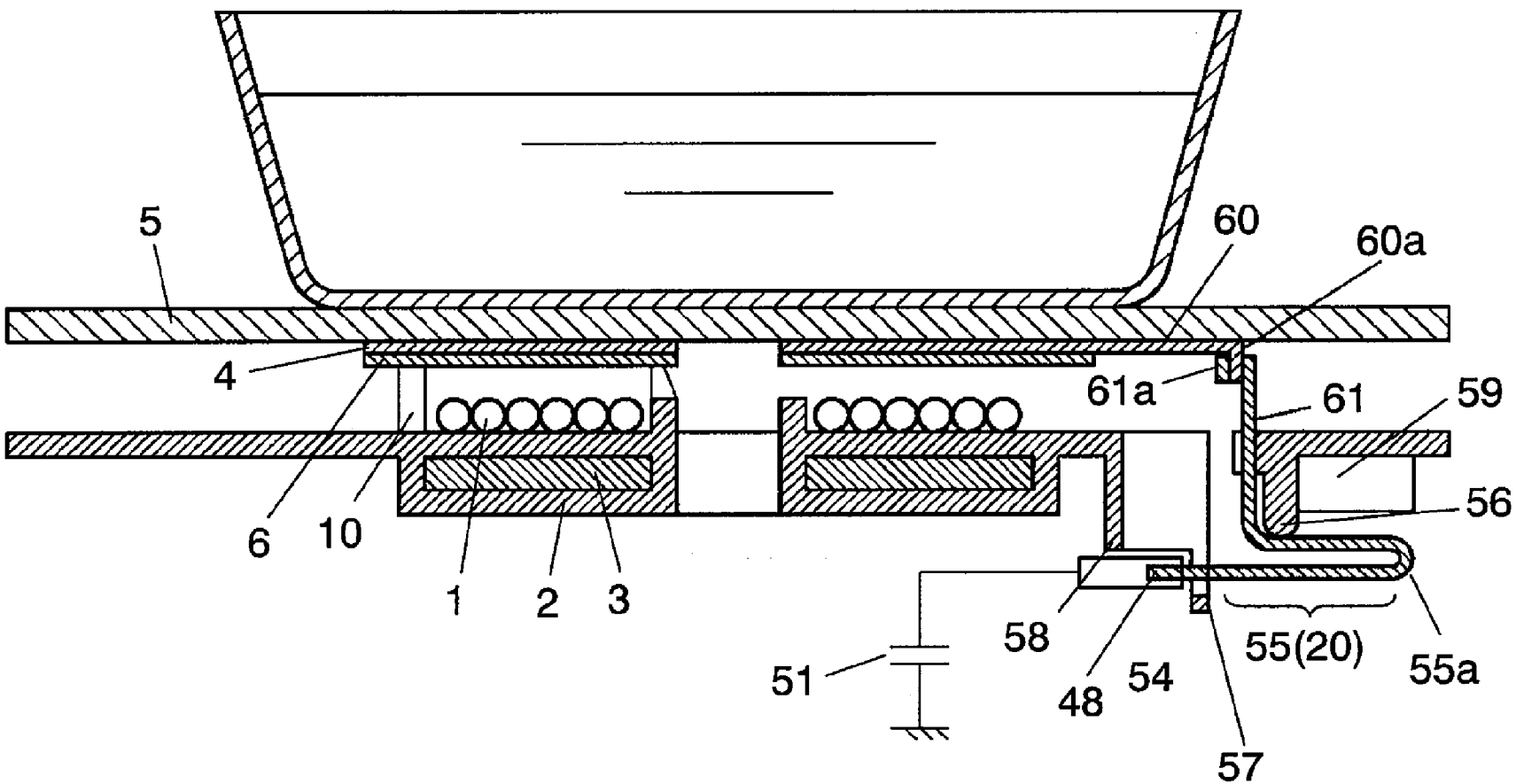
FIG. 6A is a sectional view of a key part of an induction heater in accordance with a fourth exemplary embodiment of the present invention.
Figure 6B:
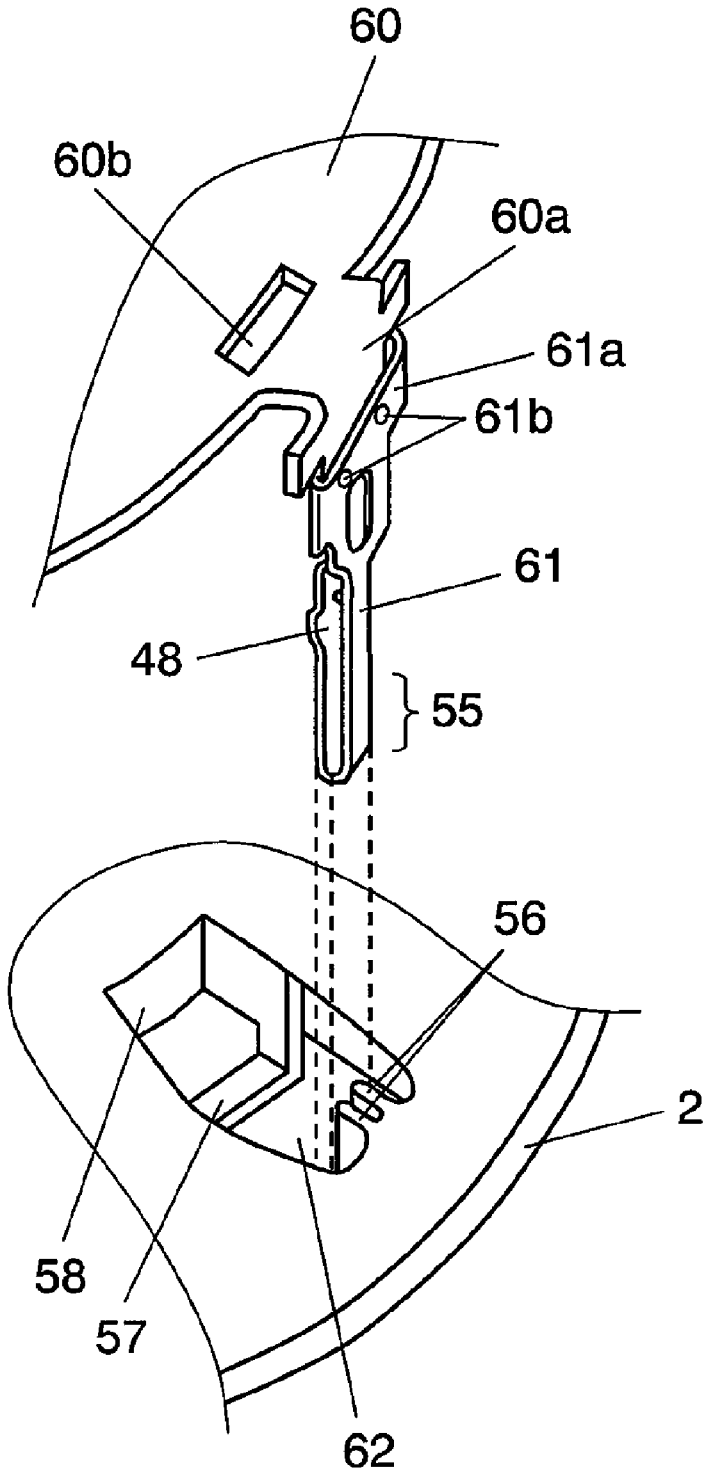
FIG. 6B is a perspective view of the induction heater in accordance with the fourth exemplary embodiment of the present invention.
Figure 6C:
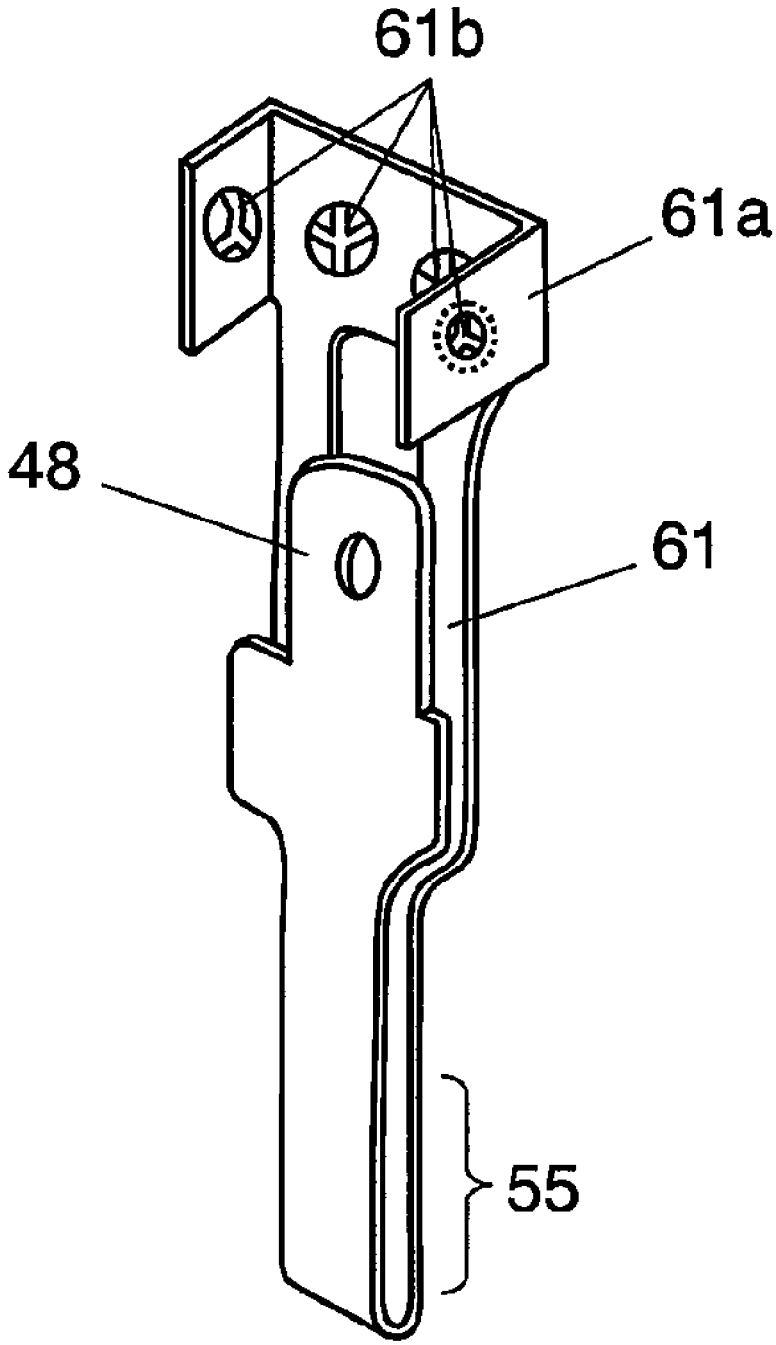
FIG. 6C is a perspective view of a key part of the induction heater in accordance with the fourth exemplary embodiment of the present invention.

FIGS. 6A, 6B, and 6C show an induction heater in the fourth exemplary embodiment of the present invention. Components same as the third exemplary embodiment are given the same reference marks to omit duplicate description.

The induction heater in the fourth exemplary embodiment has electrical conductor 60 made of aluminum or aluminum alloy, and extended portion 61 is made of a separate material, which is plated stainless steel. This stainless steel is SUS430 or SUS304, and plated typically with nickel chrome, chrome, or aluminum.

Connector 60*a* of electrical conductor 60 and connector 61*a* of extended portion 61 are coupled typically by caulking or welding. FIG. 6C shows the shape of extended portion 61 before caulking when extended portion 61 is coupled by caulking. Caulking portion 61*b* is a wedge-shaped protrusion created on an inner side of connector 61*a*. Connector 61*a* embraces connector 60*a* of electrical conductor 60 and is coupled to connector 60 by caulking. If there is a risk of corrosion due to contact of different metals, silicone or the like may be applied to a coupled part to insulate air.

When extended portion 61 is coupled to electrical conductor 60, extended portion 61 becomes roughly perpendicular to electrical conductor 60. In this state, extended portion 61 is inserted into opening 62 created in support 2, and electrical conductor 60 is placed on insulating sheet 6 on support 2. Extended portion 61 is inserted along guide 56, and protrudes below support 2.

Next, extended portion 61 is pressed and bent by hand toward an outer-peripheral direction (radial direction) of support 2 in a way such that extended portion 61 touches a lower end of guide 56 until a tip of a second curved portion, which is a curved part of extended portion 61, contacts the surface of bending angle reducer 59. Bent portion 55 of extended portion 61 springs back when the hand is released, and becomes roughly parallel to support 2. Accordingly, bending angle reducer 59 stabilizes an angle formed by bent portion 55 and extended portion 61 roughly at a right angle after bending extended portion 61.

As described above, in the fourth exemplary embodiment, electrical conductor 60 is made of aluminum or aluminum alloy, and extended portion 61 is made of different material, which is stainless steel. Since extended portion 61 having bent portion 55 is made of stainless steel, its bending strength (bending resistance) is improved compared to the case of forming extended portion 61 using aluminum or aluminum alloy which is suitable for electrical conductor. Still more, a plating layer formed by plating improves oxidization resistance of stainless steel. In particular, an increase of contact resistance at the coupled part between electrical conductor 60 and extended portion 61 is preventable, improving reliability. Plating is applied as required, and thus it can be omitted.

In the third and fourth exemplary embodiments, each electrical conductor and the low-potential part (commercial power potential, ground, or the like) are connected only at a single point of extended portion 47 or 61 in each electrical conductor 4. Alternately, extended portion 47 or 61 may be provided at multiple points of each electrical conductor 4 so as to improve reliability or detect connection by applying current between multiple extended portions 47 or 61 on the same electrical conductor 4. The safety can be further improved if electricity is applied to heating coil 1 only when the connection is satisfactory.

INDUSTRIAL APPLICABILITY

As described above, the present invention offers a highly reliable and compact induction heater which eliminates the risk of electric shock to the human body, and also prevents uplift of an object to be heated. Accordingly, the induction heater of the present invention is effective typically for induction heating cooking equipment.

The invention claimed is:

1. An induction heater, comprising:

a top plate on which an object to be heated is placed;

a heating coil provided below the top plate, the heating coil induction-heating the object to be heated, the object being made of nonmagnetic metal with electrical conductivity not less than that of aluminum; said heating coil having a high potential therein when said heating coil receives current; and an electrical conductor disposed between the top plate and the heating coil such that the electrical conductor faces the heating coil, the electrical conductor reducing buoyancy during induction-heating of the object to be heated made of nonmagnetic metal with electrical conductivity not less than that of aluminum; and a support for holding the heating coil;

wherein, the electrical conductor has an extended portion, the extended portion including at least a first segment extending downward from the electrical conductor, a second segment extending in a first radial direction from the first segment, and a third segment extending in a second radial direction opposite the first radial direction from the second segment, the second segment and the third segment joined by a bend in the extended portion, the second segment contacting a lower surface of the support; and the extended portion has a connector positioned at an end of the third segment opposite the bend; said connector connectable to a low potential which is lower than said high potential.

2. The induction heater of claim 1, wherein the extended portion is provided at a position outside of an outer periphery of the heating coil.

3. The induction heater of claim 1, wherein the extended portion further has a thermal-connection reducing means whose cross-sectional area perpendicular to an extending direction of the extended portion is smaller than a cross-sectional area perpendicular to the extending direction of the extended portion at both sides of the thermal-connection reducing means.

4. The induction heater of claim 1, wherein the extended portion further has a thermal-connection reducing means which is a part of the extended portion where at least one hole is created.

5. The induction heater of claim 1, wherein the extended portion has a curved portion, the extended portion is bent downward at the curved portion, and a cross-sectional area of the curved portion perpendicular to an extending direction is larger than a cross-sectional area of a thermal-connection reducing means perpendicular to the extending direction.

6. The induction heater of claim 1, wherein an upward displacement of the electrical conductor is restricted by the contact of the second segment of the extended portion with the lower surface of the support.

7. The induction heater of claim 1, wherein the bend has a slit.

8. The induction heater of claim 1, wherein the support further comprises a stopper for restricting a downward displacement of the extended portion.

9. The induction heater of claim 1, wherein the support further comprises a stopper for restricting an upward displacement of the coupler to the low-potential part when the coupler to the low-potential part is coupled to the connector of the extended portion.

10. The induction heater of claim 1, wherein the support has a bending angle adjuster for adjusting a bending angle of the bend.

11. The induction heater of claim 1, wherein the extended portion is made of a material different from the electrical conductor, the electrical conductor being made of one of aluminum and aluminum alloy, and the extended portion being made of stainless steel.

12. The induction heater of claim 1, wherein the extended portion is made of a material different from the electrical conductor, the electrical conductor being made of one of aluminum and aluminum alloy, and the extended portion being made of stainless steel with its surface plated.

13. The induction heater of claim 1, wherein the heating coil faces the electrical conductor with at least a space in between, and the extended portion is cooled by wind passing through the space.

14. The induction heater of claim 1, further comprising a duct at a position outside of the heating coil and inside of the extended portion, the duct feeding cooling wind toward the connector of the extended portion.

* * * * *

UNITED STATES PATENT AND TRADEMARK OFFICE

CERTIFICATE OF CORRECTION

PATENT NO. : 8,129,664 B2
APPLICATION NO. : 11/575921
DATED : March 6, 2012
INVENTOR(S) : Toshihiro Keishima et al.

It is certified that error appears in the above-identified patent and that said Letters Patent is hereby corrected as shown below:

Title Page;

In FIELD [56], page 2, FOREIGN PATENT DOCUMENTS, please delete the following duplicate references:

"JP 2003-264054 A 9/2003
JP 2005-222822 A 8/2005
WO 2004/016047 A1 2/2004"

Signed and Sealed this
Twenty-fourth Day of July, 2012

David J. Kappos

David J. Kappos
*Director of the United States Patent and Trademark Office*